United States Patent [19]

Dienes

[11] Patent Number: 5,021,797

[45] Date of Patent: Jun. 4, 1991

[54] ANTENNA FOR TRANSMITTING ELLIPTICALLY POLARIZED TELEVISION SIGNALS

[75] Inventor: Geza Dienes, Claremont, Calif.

[73] Assignee: Andrew Corporation, Orland Park, Ill.

[21] Appl. No.: 520,890

[22] Filed: May 9, 1990

[51] Int. Cl.[5] ..... H01Q 13/12

[52] U.S. Cl. ..... 343/727; 343/771

[58] Field of Search ..... 343/725, 767, 770, 771, 343/756, 890, 891, 727, 729, 730

[56] References Cited

U.S. PATENT DOCUMENTS

| | | | |
|---|---|---|---|
| 3,474,452 | 10/1969 | Bogner | 343/890 |
| 3,975,733 | 8/1976 | Bogner | 343/891 |
| 4,119,970 | 10/1978 | Bogner et al. | 343/727 |
| 4,129,871 | 12/1978 | Johns | 343/727 |

*Primary Examiner*—Michael C. Wimer

*Attorney, Agent, or Firm*—Arnold, White & Durkee

[57] ABSTRACT

An antenna for elliptically polarized television transmission comprising, an elongated cylindrical waveguide having a multiplicity of slots spaced along the length and around the circumference of the waveguide for radiating horizontally polarized energy; a multiplicity of parasitic radiating dipoles mounted on the outer surface of the waveguide and spaced along the length and around the circumference of the waveguide for radiating vertically polarized energy, each of the dipoles being associated with one of the slots so that the combination of the horizontally and vertically polarized radiation produces elliptically polarized radiation; couplers for coupling electromagnetic energy from the interior of the waveguide to the slots; and a pair of coupling capacitors on opposite sides of each slot and connected to the radiating elements of the associated dipole for coupling electromagnetic energy from the field around the slot into the respective radiating elements.

17 Claims, 4 Drawing Sheets

ANTENNA FOR TRANSMITTING ELLIPTICALLY POLARIZED TELEVISION SIGNALS

FIELD OF THE INVENTION

The present invention relates to antennas for transmitting television signals with elliptical polarization.

BACKGROUND OF THE INVENTION

Antennas comprising slotted cylindrical waveguides have been widely used to transmit television signals. In recent years it has become increasingly popular to transmit television signals with circular polarization, primarily to improve the reception of such signals in congested metropolitan areas. As is well known, a transmitting antenna can produce a circularly polarized wave by radiating separate vertically and horizontally polarized waves having the same amplitude with a 90° phase difference. The combination of the vertically and horizontally polarized Waves produces an elliptically polarized wave, with the degree of ellipticity expressed as the "axial ratio,"which is the ratio of the major axis to the minor axis of the ellipse.

SUMMARY OF THE INVENTION

It is a primary object of the present invention to provide an improved antenna for transmitting television signals with elliptical polarization, and which facilitates attainment of the desired axial ratio of the radiated field. In this connection, a related object of the invention is to provide such an antenna in which the magnitude and the phase relationships of the orthogonally polarized signals are readily controlled and are independently variable. That is, the phase relationship between the orthogonally polarized radiated fields may be controlled without disturbing the amplitude relationship between those fields.

It is another object of this invention to provide such on improved antenna which has a low windload due to its small profile.

Yet another object of the invention is to provide such an improved antenna which requires a small number of parts and can be efficiently and economically fabricated.

A still further object of the invention is to provide such an improved antenna which can be easily adjusted for use over a wide frequency band, e.g., for a number of different television channels, with only a few minor adjustments.

Other objects and advantages of the invention will become apparent upon reading the following detailed description and upon reference to the accompanying drawings.

DESCRIPTION OF THE PREFERRED EMBODIMENT

Figure 2:
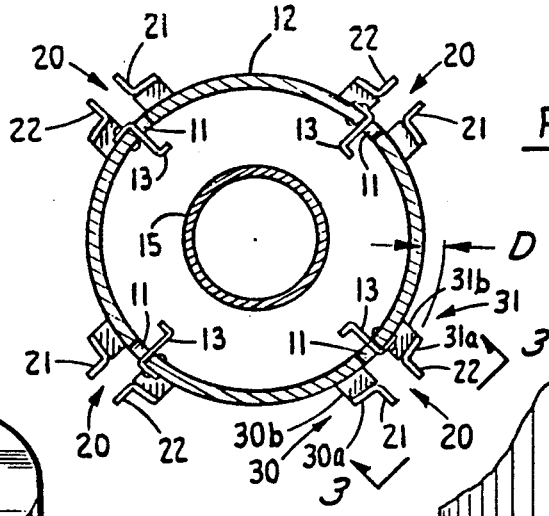
FIG. 2 is a section taken generally along line 2—2 in FIG. 1.

While the invention is susceptible to various modifications and alternative forms, certain specific embodiments thereof have been shown by way of example in the drawings and will be described in detail. It should be understood, however, that it is not intended to limit the invention to the particular forms disclosed, but, on the contrary, the intention is to cover all modifications, equivalents, and alternatives falling within the scope of the invention as defined by the appended claims.

Figure 1:
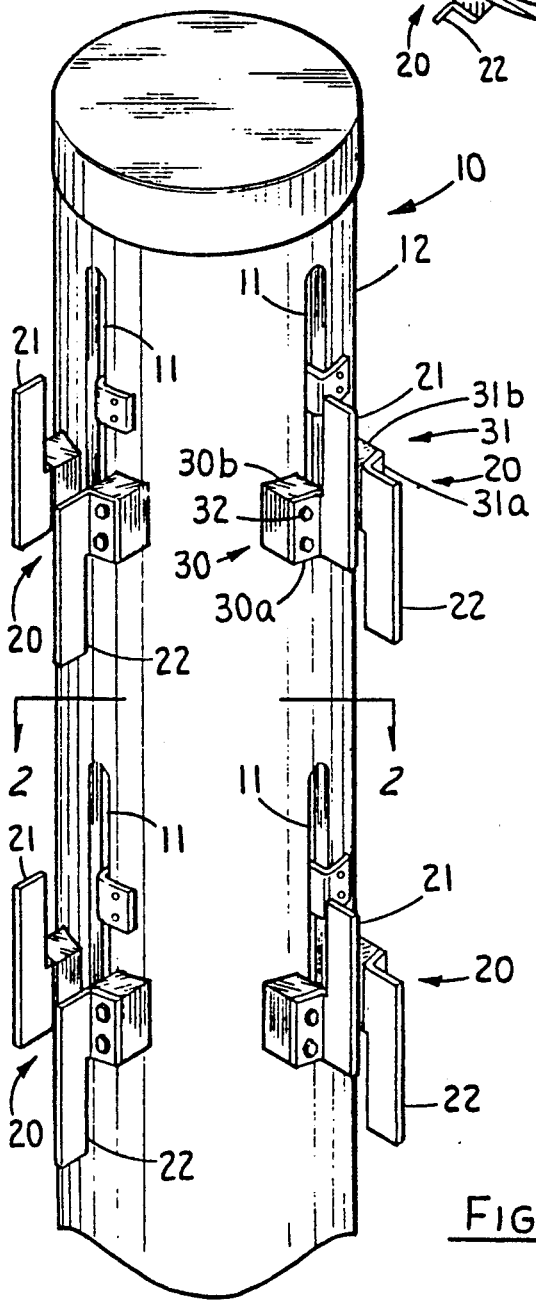
FIG. 1 is a perspective view of a portion of a television broadcast antenna embodying the present invention.

Referring now to FIG. 1, television signals are broadcast by an antenna 10 which is typically mounted on the top of a tower or tall building. The antenna 10 includes a vertically cylindrical circular, coaxial waveguide 12, defined by inner conductor 15 and outer conductor 17, having an array of vertically elongated radiating slots 11 which are spaced at 120° intervals around the circumference of the antenna and at approximately one-wavelength intervals (center-to-center) along the length of the antenna. The slots 11 are aligned with each other in both the longitudinal and circumferential directions. The length of each slot 11 in the direction of its major axis is normally between 0.375 and 0.85.

It will be appreciated that the invention is applicable to waveguides that are not circular, such as waveguides having rectangular or D-shaped cross-sections. It should also be recognized that the waveguide 12 may be non-coaxial waveguide rather than the circular (coaxial) waveguide described above.

Figure 3:
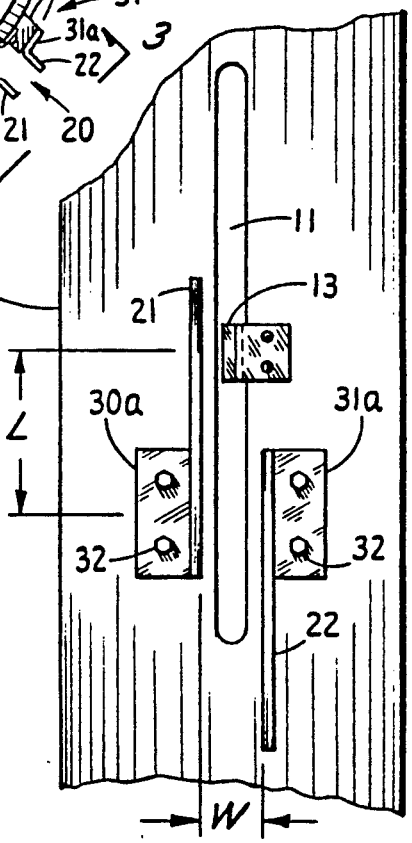
FIG. 3 is a fragmentary side elevation of a portion of the antenna shown in FIG. 1, taken generally along line 3—3 in FIG. 2.

For the purpose of coupling electromagnetic energy from the interior to the exterior of the waveguide, via the slots 11, a coupling probe 13 is mounted midway along one of the vertical edges of each slot and extends into the interior of the waveguide 12. Probes of this type are well known in the waveguide antenna art and, as can be seen in FIGS. 2 and 3, each probe 13 typically comprises a small Z-shaped plate 14 which extends radially inwardly from the edge of the slot. Each probe 13 picks up energy from the interior of the waveguide 12 and feeds it to the corresponding slot 11 from which the energy is radiated with horizontal polarization.

Vertically polarized radiation from the antenna 10 is produced by an array of vertically oriented parasitic dipoles 20 which are arranged in the same overall configuration as the slots 11; each dipole is associated with one of the slots 11. In the illustrative embodiment of FIGS. 1-3, each parasitic dipole 20 comprises two radiating elements in the form of parallel vanes 21 and 22 spaced from the outer surface of the waveguide 12 on opposite sides of the associated slot and extending parallel to the vertical edges of the slots. As is well known, the combination of the horizontally and vertically polarized radiation produces elliptically (preferably circularly) polarized radiation.

The vanes 21 and 22 are made of a conductive metal such as aluminum. The opposed surfaces of the two vanes 21 and 22 are set apart from each other by a distance W (FIG. 3), and the inner edges of the vanes are spaced away from the outer surface of the waveguide by a distance D (FIG. 2). The impedance of the dipole 20 formed by the two vanes 21 and 22 is a function of the two distances W and D, and the length of the vanes in the axial direction.

In accordance with one feature of the present invention, each parasitic dipole 20 is coupled to the electromagnetic field around its associated slot 11 by a pair of coupling capacitors 30 and 31 connected to the respective radiating elements 21 and 22 on opposite sides of each slot. These capacitors couple electromagnetic energy from the field around the slot into the respective radiating elements.

In the illustrative arrangement, each coupling capacitor is formed by a conductive metal plate 30*a* or 31*a* spaced away from the conductive outer surface of the waveguide 12 by the distance D. The plates 30*a* and 31*a* are preferably formed as unitary parts of the respective vanes 21 and 22. To form the desired capacitor, each metal plate 30*a* or 31*a* must be electrically insulated from the outer surface of the waveguide 12, such as by means of the dielectric pads 30*b* and 31*b* shown in FIGS. 1 and 2. The vanes 21 and 22, the metal plates 30*a* and 31*a*, and the dielectric pads 30*a* and 30*b* are all fastened to the waveguide 12 by non-conductive screws 32. The capacitance of each coupling capacitor is determined by the surface area of the metal plate 30*a* or 31*a* and the distance D between that metal plate and the outer surface of the waveguide 12.

One advantage of the present invention is that it permits the magnitude of the signal that is coupled into the parasitic radiators to be varied independently of the phase relationship between the vertically and horizontally polarized radiation. The phase relationship of the cross-polarized radiation depends on the capacitance of the coupling capacitors and the impedance of the parasitic dipole, whereas the magnitude of the signal that is coupled into the parasitic dipole depends on that same capacitance and impedance plus the distance L between the horizontal centerline of the slot 11 and the centerline of the coupling capacitors 30 and 31. Consequently, by varying the distance L, the magnitude of the vertically polarized radiation can be varied independently of the phase relationship between the vertically and horizontally polarized radiation. The parasitic dipole and its coupling capacitors may be offset from the centerline of the slot 11 in either vertical direction, i.e., the centerline of the coupling capacitors 30 and 31 may be either above or blow the center of the slot 11. In certain situations it may be desirable for the two centerlines to be at the same elevation so that there is no offset whatever.

Figure 4:
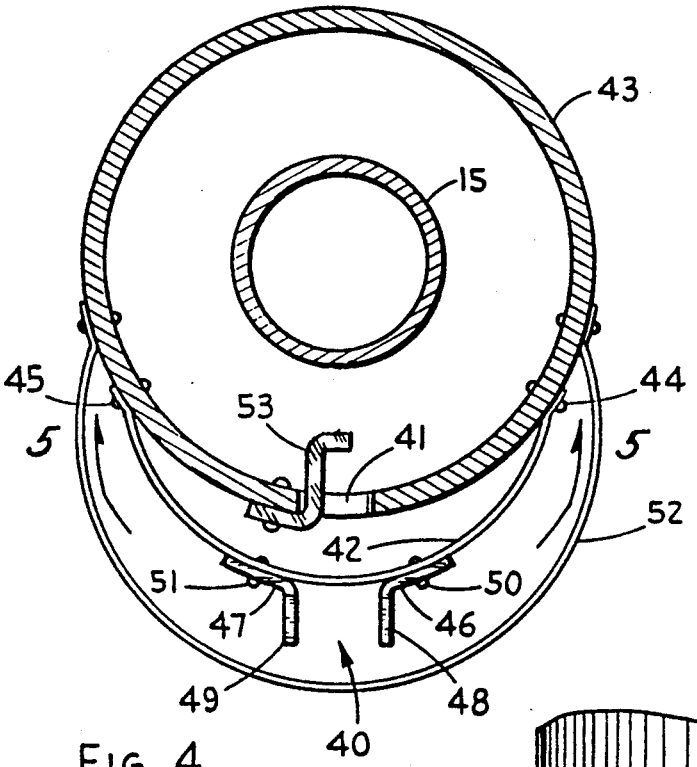
FIG. 4 is a horizontal section taken through a modified embodiment of a television broadcast antenna embodying the present invention.
Figure 5:
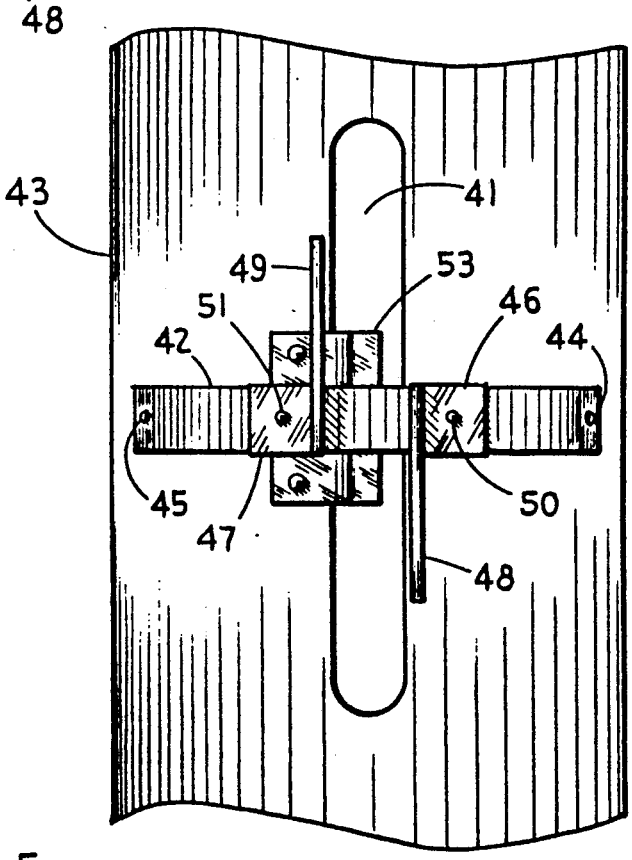
FIG. 5 is a fragmentary side elevation of a portion of the antenna shown in FIG. 4, taken generally along line 5—5 in FIG. 4.

Another embodiment of the present invention is shown in FIGS. 4 and 5. In this embodiment the parasitic dipole 40 associated with each radiating slot 41 is mounted on an arcuate dielectric member 42 which arches across the slot 41. The ends of the dielectric member 42 are fastened to the cylindrical waveguide 43 by fasteners 44 and 45, which may be rivets or screws. The outer plates 46 and 47 of the coupling capacitors are formed as integral parts of the dipole elements 48 and 49, and are rigidly attached to the dielectric member 42 by fasteners 50 and 51. A radome 52 encloses both the parasitic dipole 40 and its dielectric support 42, and is attached to the outer surface of the waveguide 43 beyond the ends of the support member 42.

In the embodiment of FIGS. 4 and 5, the air serves as the dielectric between the inner and outer conductive elements of the two coupling capacitors associated with each dipole. As can be seen in FIG. 5, this design facilitates locating the centerline of the two coupling capacitors on the transverse centerline of the slot 41 (when it is desired to have L=O) because the dielectric support 42 arches over the coupling probe 53 for the radiating slot 41.

As a further feature of the invention, the parasitic dipole is fastened to the slotted waveguide by means of a shorted quarter-wavelength stub. This mounting arrangement offers the advantage of providing a direct electrical connection between the parasitic dipole and the main waveguide, rather than having the dipole separated from he waveguide by a dielectric support or spacer. Two different mounting arrangements using a shorted quarter-wavelength stub are shown in FIGS. 6–7 and 8–9, respectively.

Figure 6:
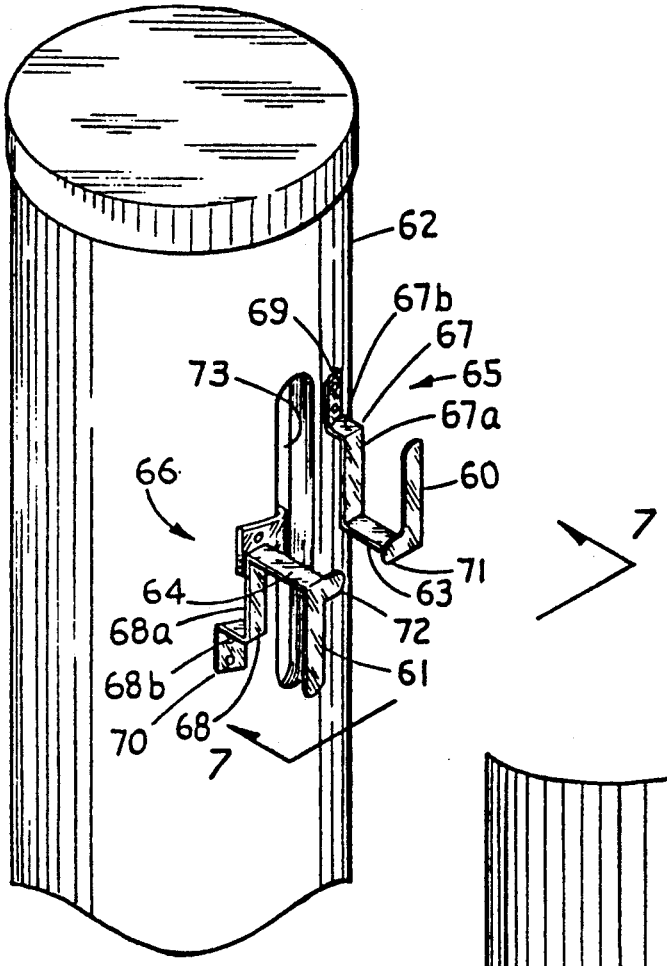
FIG. 6 is a prospective view of a portion of another modified embodiment of a television broadcast antenna embodying the present invention.
Figure 7:
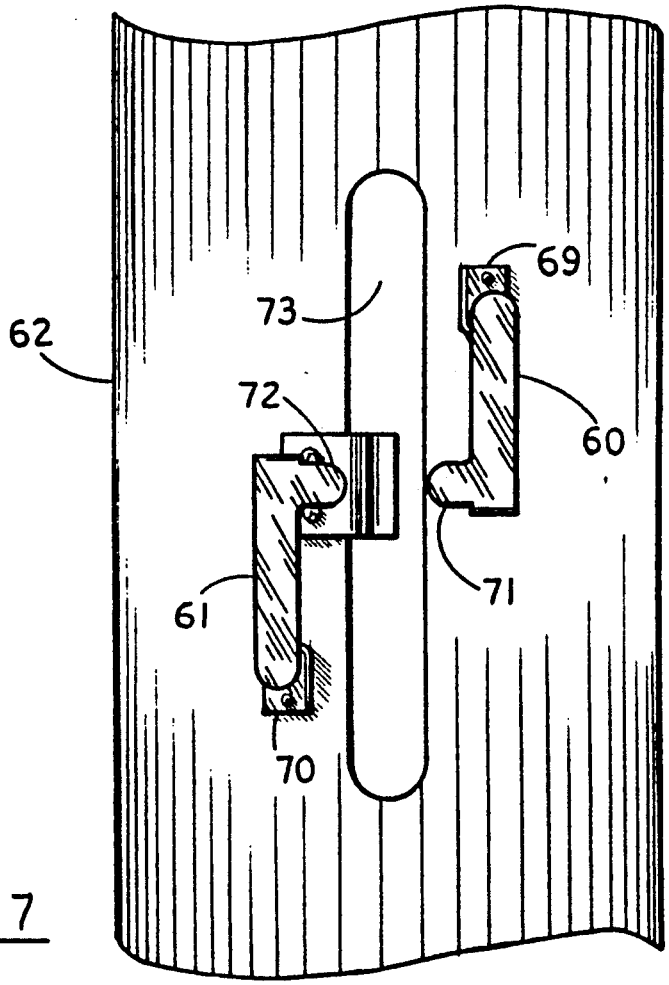
FIG. 7 is an enlarged fragmentary side elevation of a portion of the antenna shown in FIG. 6, taken generally along the line 7—7 in FIG. 6.

Turning first to FIGS. 6 and 7, the two radiating elements 60 and 61 of a parasitic dipole are connected to a slotted waveguide 62 by a pair of radial arms 63 and 64 and corresponding quarter-wavelength stubs 65 and 66, respectively. The stubs 65 and 66 are formed by L-shaped elements 67 and 68 which have the long arms 67*a* and 68*a* of the L's extending parallel to the underlying surface of the waveguide 62 and spaced therefrom by the short arms 67*b* and 68*b*. The long arms 67*a* and 68*a* have a length of a quarter wavelength, and the short arms 67*b* and 68*b* are about 0.25 to 0.4 inch in length. Flanges 69 and 70 at the ends of the short arms 67*b* and 68*b* are used to attach the L-shaped elements 67 and 68 to the waveguide 62.

The coupling capacitors for supplying electromagnetic energy to the radiating elements 60 and 61 are formed by tabs 71 and 72 projecting inwardly toward the slot 73 from the bases of the elements 60 and 61. The combination of the tabs 71, 72 and the underlying metal surface of the waveguide 62 forms air-dielectric capacitors which couple electromagnetic energy from the field around the slot 73 into the radiating elements 60 and 61.

Figure 8:
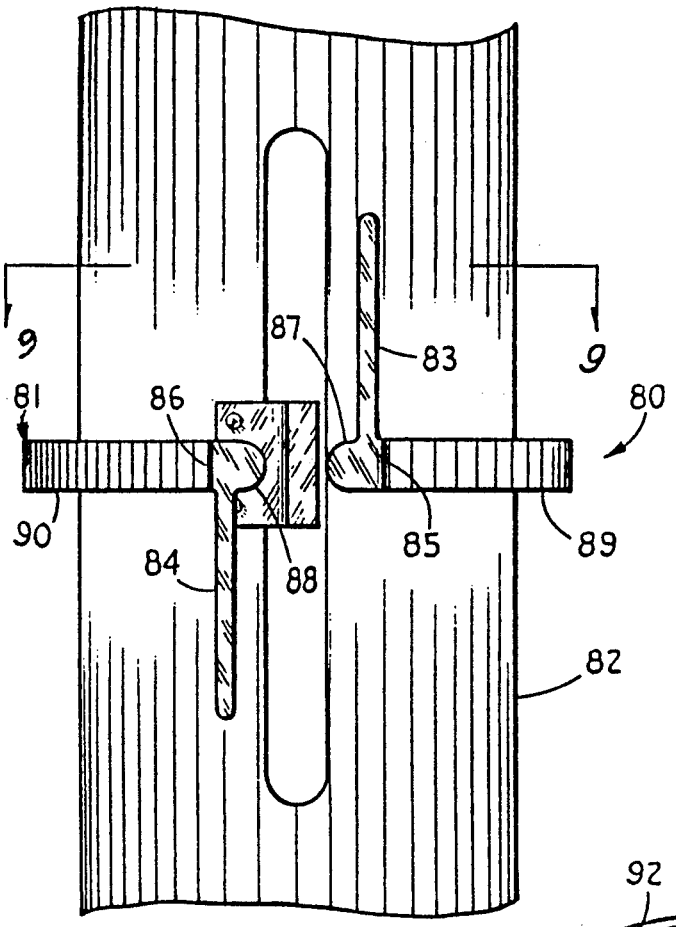
FIG. 8 is a fragmentary side elevation of a portion of still another modified embodiment of a television broadcast antenna embodying the present invention.
Figure 9:
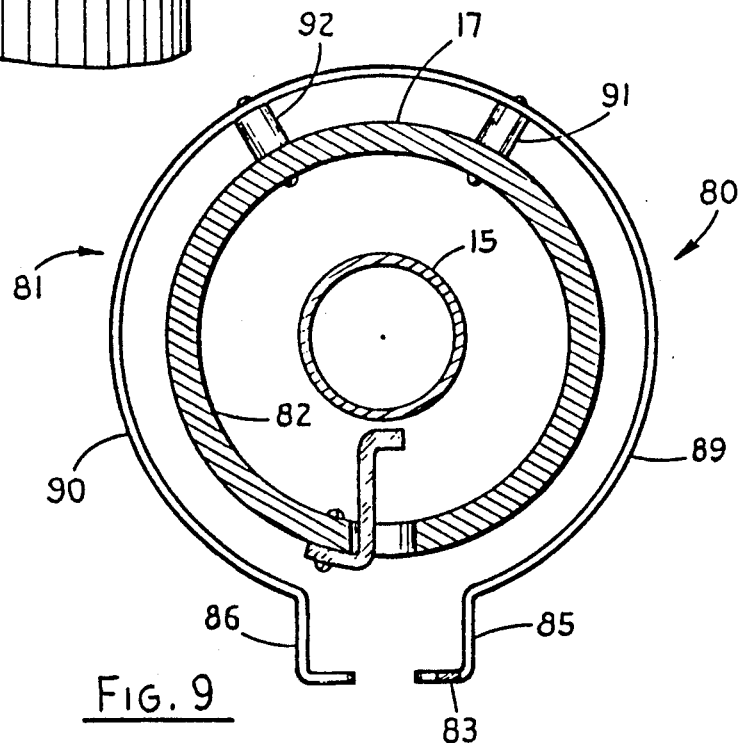
FIG. 9 is a section taken generally along line 9—9 in FIG. 8.

A modified form of quarter-wavelength stub is shown in FIGS. 8 and 9. In this case the stubs 80 and 81 extend circumferentially around the slotted waveguide 82 rather than longitudinally along the waveguide 82. The radiating elements 83 and 84, the radial arms 85 and 86, and the tabs 87 and 88 are the same as the corresponding elements in the embodiment of FIGS. 6 and 7. The inner ends of the radial arms 85 and 86 are attached to the quarter-wavelength stubs 80 and 81 formed by quarter-wavelength arcuate metal strips 89 and 90 extending around the waveguide 82 to respective shorting elements 91 and 92 which connect the strips 89 and 90 to the waveguide 82.

The present invention is also advantageous because it provides an antenna with a small diametrical profile and, therefore, a relatively small windload. For example, in the design of FIGS. 6 and 7 the outer surfaces of the radiating elements may be spaced only about 1.5 inches from the outer surface of the slotted waveguide; thus the parasitic dipoles increase the overall diameter of the slotted waveguide by only about three inches, which is about half the increase in size necessitated by other parasitic radiators.

As is well understood in the art, all references herein to elliptical polarization, with the degree of ellipticity expressed as the "axial ratio,"are intended to include circular polarization in which the ratio of the major axis to the minor axis of the ellipse is equal to 1.

What is claimed is:

1. An antenna for elliptically polarized television transmission comprising, a vertically elongated cylindrical waveguide having a multiplicity of vertically elongated slots, each of which is defined at least in part by associated vertical sides, spaced along the length and around the circumference thereof for radiating horizontally polarized energy, coupling means for coupling electromagnetic energy from the interior of said waveguide to said slots, parasitic radiating dipoles mounted on the outer surface of said waveguide adjacent each of said slots for radiating vertically polarized energy, so that the combination of the radiated horizontally and vertically polarized energy produces elliptically polarized energy, each of said parasitic dipoles comprising a pair of elongated radiating elements, each of said elements spaced from the outer surface of said waveguide along a respective one of the vertical sides of the associated slot and each being at least partially offset relative to the other of said radiating elements in a direction that is parallel to the vertical sides, and a pair of coupling capacitors on opposite sides of each slot along the vertical sides thereof and connected to the respective radiating elements for coupling electromagnetic energy from the field around the slot into the respective radiating elements.

2. The antenna of claim 1 wherein each of said coupling capacitors is formed by a metal plate connected to one of said radiating elements and a dielectric spacing said plate from the outer surface of said waveguide.

3. The antenna of claim 2 wherein said metal plate and the associated radiating element are formed as a unitary part.

4. The antenna of claim 2 wherein said radiating elements are supported by said metal plates, which in turn are supported by dielectric spacing means attached to said waveguide.

5. The antenna of claim 4 wherein said dielectric spacing means comprises an arcuate dielectric member extending over and associated one of said elongated slots, said member being attached to said waveguide on opposite sides of said associated one of said elongated slots.

6. The antenna of claim 2 wherein (1) the surface areas of said metal plates and (2) the distance between each plate and the surface of said waveguide, are selected to produce the desired phase relationship between the orthogonally polarized signals.

7. The antenna of claim 1 wherein said cylindrical waveguide is a coaxial waveguide.

8. The antenna of claim 1 wherein said cylindrical waveguide is a non-coaxial waveguide.

9. The antenna of claim 1 wherein said radiating elements are flat vanes which are substantially parallel to the vertical side walls of the associated slot.

10. The antenna of claim 1 wherein said radiating elements are supported by dielectric spacing means attached to said waveguide.

11. The antenna of claim 1 wherein said radiating elements are fastened to said waveguide by dielectric mounting means.

12. The antenna of claim 11 wherein said dielectric mounting means also forms a dielectric spacer for said coupling capacitors.

13. The antenna of claim 1 wherein said radiating elements are fastened to said waveguide via quarter-wavelength stubs.

14. The antenna of claim 13 wherein said quarter-wavelength stubs are shorted to said waveguide.

15. The antenna of claim 13 wherein said quarter-wavelength stubs extend longitudinally along the surface of said waveguide.

16. The antenna of claim 13 wherein said quarter-wavelength stubs extend circumferentially along the surface of said waveguide.

17. An antenna for elliptically polarized television transmission comprising an elongated waveguide having a multiplicity of slots spaced along the length and around the circumference of the waveguide for radiating horizontally polarized energy a multiplicity of parasitic dipoles mounted on the outer surface of said waveguide and spaced along the length and around the circumference of the waveguide for radiating vertically polarized energy, said dipoles being arranged adjacent said slots so that the combination of the radiated horizontally and vertically polarized energy produces elliptically polarized energy, first coupling means for coupling electromagnetic energy from the interior of said waveguide to said slots, and second coupling means for coupling electromagnetic energy radiated around said slots to said dipoles and including a pair of capacitors located near an edge region of one of said slots for feeding electromagnetic energy from the exterior surface of said waveguide to said dipoles.

* * * * *